US009127695B2

(12) United States Patent
Lougheed

(10) Patent No.: US 9,127,695 B2
(45) Date of Patent: Sep. 8, 2015

(54) SELECTABLE HYDRAULIC FLOW CONTROL CIRCUIT

(75) Inventor: Christopher W. Lougheed, Litchfield, MN (US)

(73) Assignee: Clark Equipment Company, West Fargo, ND (US)

( * ) Notice: Subject to any disclaimer, the term of this patent is extended or adjusted under 35 U.S.C. 154(b) by 441 days.

(21) Appl. No.: 13/594,417

(22) Filed: Aug. 24, 2012

(65) Prior Publication Data

US 2013/0047834 A1 Feb. 28, 2013

Related U.S. Application Data

(60) Provisional application No. 61/526,882, filed on Aug. 24, 2011.

(51) Int. Cl.

| | |
|---|---|
| ***F15B 11/05*** | (2006.01) |
| ***E02F 9/22*** | (2006.01) |
| ***F15B 11/16*** | (2006.01) |

(52) U.S. Cl.

CPC ..... *F15B 11/055* (2013.01); *E02F 9/2228* (2013.01); *F15B 11/162* (2013.01); *F15B 2211/30515* (2013.01); *F15B 2211/50536* (2013.01); *F15B 2211/781* (2013.01)

(58) Field of Classification Search

CPC ..... F15B 11/055; F15B 11/162; F15B 2211/50536; F15B 2211/781; E02F 9/2228

USPC ..... 60/421, 422, 424; 91/516, 526, 532

See application file for complete search history.

(56) References Cited

U.S. PATENT DOCUMENTS

| | | | | |
|---|---|---|---|---|
| 4,343,151 A * | 8/1982 | Lorimor | ..... | 91/516 |
| 6,354,081 B1 * | 3/2002 | Burton | ..... | 60/427 |

* cited by examiner

*Primary Examiner* — Thomas E Lazo

(74) *Attorney, Agent, or Firm* — John D. Veldhuis-Kroeze; Westman, Champlin & Koehler, P.A.

(57) ABSTRACT

Disclosed embodiments of power machines, implements and hydraulic systems utilize a hydraulic flow control circuit and method to implement multiple modes of operation while optimizing hydraulic fluid flow to either or both of primary and secondary function devices.

20 Claims, 5 Drawing Sheets

SELECTABLE HYDRAULIC FLOW CONTROL CIRCUIT

CROSS-REFERENCE TO RELATED APPLICATION

The present application is based on and claims the benefit of U.S. provisional patent application Ser. No. 61/526,882, filed Aug. 24, 2012, the content of which is hereby incorporated by reference in its entirety.

FIELD

Disclosed embodiments relate to power machines, implements, and associated hydraulic systems and methods. More particularly, disclosed embodiments relate to power machines, implements, hydraulic systems and methods which utilize a selectable hydraulic flow control circuit to control hydraulic fluid flow to both a primary function and one or more secondary functions of an implement.

BACKGROUND

Loaders and other power machines typically utilize a hydraulic system including one or more hydraulic pumps, in conjunction with control valves and actuators, to power travel motors, to raise, lower, and, in some cases, extend and retract a boom or an arm, to power hydraulic implements operably coupled to the power machine, and the like. Many hydraulic implements that are capable of being operably coupled to, and receive hydraulic fluid from a power machine have a primary function and one or more secondary functions which are all hydraulically powered. That is, such implements accomplish a plurality of functions through hydraulic devices located on the implement, with a primary function supported by secondary functions. For example, cutting type implements such as planers, slab cutters, and stump grinders, have a hydraulic motor driven cutting wheel or drum for cutting a material and this cutting wheel is a primary function on the implement. Secondary functions of such an implement include functions that position or move the cutting wheel or drum to desired positions, in desired patterns, at desired speeds or patterns to achieve feed rates, etc. For example, in a planer, one secondary function is a side shift function, while two other secondary functions control left and right moving skis. In another example, in a stump grinder, one secondary function is an arm raising or lowering function that positions the cutting wheel. Another secondary function of a stump grinder controls lateral movement of the cutting wheel.

On a conventional implement of this type, hydraulic fluid for an implement is provided from a hydraulic system on the power machine to a first coupler, often a male coupler, on the implement primarily for purposes of performing the primary function. The conventional implement is further capable of diverting small amounts of hydraulic fluid to perform the secondary functions, i.e, the diverted fluid is not provided to the primary function. Because providing flow to the primary function is deemed to be the highest priority on conventional implements, relatively little flow may be left to provide to secondary functions, leaving the secondary functions less than optimally supplied with hydraulic fluid and therefore the secondary functions often operate more slowly than desired. In addition, diversion of hydraulic fluid from the primary function, for example from a hydraulic motor, can result in the primary function operating at a less than peak level. When the primary function is not active but an operator wishes to employ secondary functions to, for example, position the primary element, conventional implements employ the same diversion technique, resulting in a large amount of oil being provide to the implement, only a relatively small portion of which is provided through a diverter to the secondary device or devices that are being actuated. The remainder of the hydraulic fluid is merely returned to tank. The entire process results in the creation of unwanted heat in the hydraulic system. In addition, the secondary function still often operate more slowly than desired.

The discussion above is merely provided for general background information and is not intended to be used as an aid in determining the scope of any claimed subject matter.

SUMMARY

Disclosed embodiments of power machines, implements and hydraulic systems utilize a hydraulic flow control circuit and method to implement multiple modes of operation while optimizing hydraulic fluid flow to either or both of primary and secondary function devices. In primary modes of operation, hydraulic fluid is provided to the implement through a first conduit and exits through a different conduit. In a first of the primary modes of operation, a primary function device is active and provided with hydraulic fluid flow, but the secondary function devices are not active and hydraulic fluid can be returned to the power machine through a second conduit without passing through the secondary function devices. In a second of the primary modes of operation, in addition to the primary function being active, one or more secondary function devices are actuated. In this instance, the hydraulic fluid entering through the first conduit is also routed through the secondary function devices and can be returned to the power machine through a third conduit. In a third mode of operation in which the primary function device is inactive but one or more secondary function devices are active, the direction of flow of hydraulic fluid can be altered such that the fluid is ported in the opposite direction by entering the second conduit and exiting at the third conduit.

This Summary and the Abstract are provided to introduce a selection of concepts in a simplified form that are further described below in the Detailed Description. This Summary is not intended to identify key features or essential features of the claimed subject matter, nor is it intended to be used as an aid in determining the scope of any claimed subject matter.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
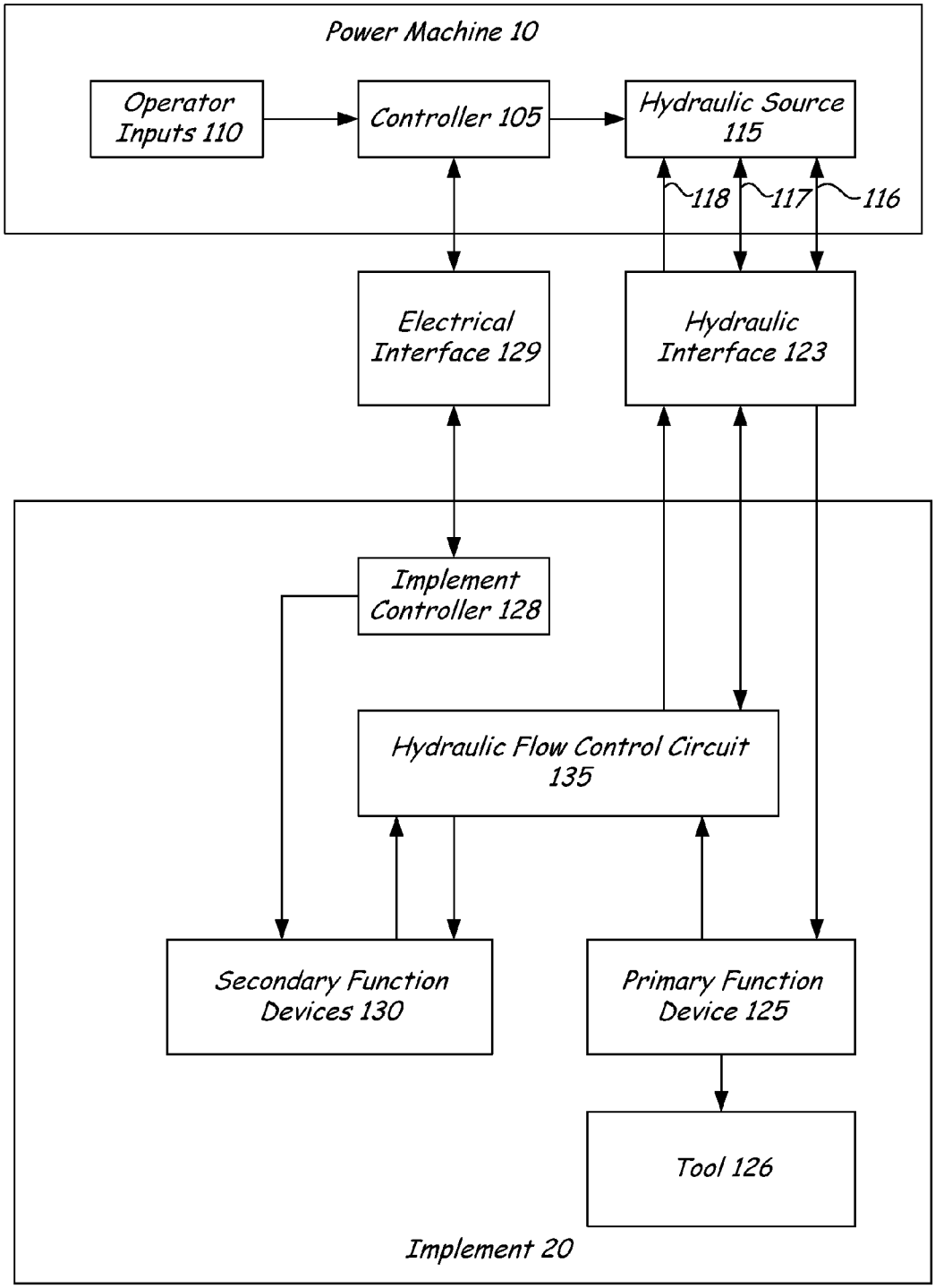
FIG. 1 is a block diagram illustrating a power machine having a hydraulic system coupled to an implement with a selectable hydraulic flow control circuit controlling hydraulic fluid flow to primary and secondary functions of the implement.

Referring to FIG. 1, a power machine 10, operably coupled to, and in hydraulic communication with, an implement 20 is schematically illustrated. Power machine 10 can be, for example, a loader, utility vehicle, telehandler, excavator, or other types of machines, mobile or otherwise, that provide a hydraulic source capable of being coupled to hydraulic devices on an implement. Implement 20 can be any of a number of different types of work implements configured to be hydraulically coupled to the power machine 10 such that hydraulic power for operating the implement is provided from a hydraulic system on the power machine. In an exemplary embodiment, power machine 10 is a loader and implement 20 is a cutting type implement such as a planer, a slab cutter, a stump grinder, etc. However, power machine 10 is not limited to being a loader and implement 20 is not limited to being a cutting type implement. Generally, implement 20, for the purposes of this discussion, can be any hydraulically powered implement having a primary function and one or more secondary functions. In an exemplary embodiment described herein, the primary function is a cutting or grinding function performed by a hydraulic motor driven cutting wheel, drum, or other tool. In the exemplary embodiment, the secondary functions of the implement are functions that position or move the cutting wheel, drum, or other tool to desired positions, in desired patterns, at desired speeds or speed patterns to achieve feed rates, etc. A first example of an implement that implement 20 of FIG. 1 generally represents is a planer. An exemplary planer has a hydraulically controlled primary device, such as toothed drum, that is capable of grinding concrete, asphalt, and the like in a planing operation. Secondary devices on the planer illustratively include devices such as hydraulically controlled linear actuators that are capable of positioning the primary device as desired. For example, some planers have a side shift function capable of lateral positioning of the primary device. In addition, hydraulically controlled left and right skis can be manipulated to adjust the primary device vertically. A second example of an implement of the type where the concepts discussed herein can be usefully employed is a stump grinder. An exemplary stump grinder has a toothed wheel supported by an arm and capable of cutting a tree stump as a primary device. Secondary devices illustratively include an arm raising or lowering device and a telescoping device for positioning the cutting wheel and a lateral movement device that controls lateral movement of the cutting wheel while grinding a tree stump. A third example implement is a concrete cutting implement that is capable of cutting a relatively narrow trench into concrete and similar materials. The concrete cutting implement has a primary device in the form of a cutting wheel and secondary devices in the form of lateral and vertical adjustment devices for the cutting wheel and a feed drive to pull the wheel through a cut. These examples are but three from large number of implements upon which the disclosed embodiments may be advantageously utilized.

In one example embodiment, power machine 10 has a controller 105, for example, an electronic control device that is in electrical communication with one or more operator input devices 110 that can be manipulated or actuated by an operator. In one embodiment, controller 105 is a single, microprocessor based electronic control device. Alternatively, controller 105 can take on a number of different forms. Controller 105, as shown in FIG. 1, can represent a plurality of electronic control devices on the power machine that are capable of communicating with each other in a distributed computing arrangement. The power machine 10 can have any number of operator input devices 110 and each of these input devices has an actuation mechanism such as a switch, slider, button, variable input device, or a touch screen display, to name but a few non-limiting examples. Each of the operator input devices 110 illustratively provides a signal indicative of its actuation state to the controller 105. The signal from any particular input device can be a voltage or a current level, or a digital communication string according to any communication protocol. Such a communication string can be provided via a hardwired connection with an operator input device or via a wireless communication scheme. Any other suitable communication means or combination of communication means between operator inputs and the controller 105 may be employed without departing from the scope of the disclosure. It should be appreciated that while the operable inputs 110 are schematically shown in FIG. 1 as being located on the power machine 10, in alternate embodiments, the operator inputs can be located on any device capable of communicating indications of operator input actuations to the implement 20. For the purposes of this discussion, actuable operator inputs 110 refers to input devices actuable to control functions related to the implement 20. The controller 105 illustratively provides control signals to a hydraulic power source 115, which, in turn, is configured to provide hydraulic fluid to hydraulic components on the implement 20 in one of two directions via hydraulic conduits 116 and 117, depending at least in part on the control signals provided to the controller 105 from the operator inputs 110 when the implement 20 is in hydraulic communication with the power machine 10. The hydraulic power source 115 illustratively includes a hydraulic pump and the necessary hydraulic components such as a valve (not shown), such that when the power machine 10 provides pressurized hydraulic fluid via hydraulic conduit 116, hydraulic conduit 117 is configured to receive return flow from an implement, return flow that eventually is returned to a hydraulic reservoir (not shown), thereby making the hydraulic fluid available to an inlet of the hydraulic pump. Conversely, when the power machine 10 provides pressurized hydraulic fluid via hydraulic conduit 117, a third hydraulic conduit 118 is configured to receive return flow from an implement. The third hydraulic conduit 118 provides an additional return line to receive hydraulic fluid from the implement 20. This third hydraulic conduit 118 is sometimes known as a case drain line, as on some implements it provides a path for return hydraulic flow for a primary device such as a hydraulic motor when hydraulic pressures in the motor reach a certain level.

Implement 20 has first, second, and third hydraulic conduits 120, 121, and 122 that are configured to be hydraulically coupled to first, second and third hydraulic conduits 116, 117 and 118, respectively on the power machine 10 via a hydraulic interface 123. The hydraulic interface 123 can include any suitable coupling devices to couple the conduits together. Implement 20 also has an implement controller 128 that, in one embodiment, is a microprocessor based electronic controller capable of communicating with the controller 105 onboard the power machine 10. Implement controller 128 is configured to communicate with controller 105 onboard power machine 10 when the implement controller 128 is coupled to the power machine via electrical interface 129. Implement controller 128 is configured to provide information to the power machine 10 about the implement 20 and control various devices on the implement 20, as is discussed below.

Implement 20 includes a primary function actuator 125 and one or more secondary function actuator(s) 130, each of which is in hydraulic communication with a control circuit 135. The primary function actuator 125 illustratively includes a hydraulic component, such as a hydraulic motor that is operably coupled to and powers a primary tool 126. The primary tool generally performs the primary work of the implement and the primary function actuator 125 generally consumes more hydraulic power than the secondary function actuators 130. The secondary function actuator(s) 130 illustratively include hydraulic components such as hydraulic cylinders or other hydraulic actuators used to position or move the primary tool 126. However, the disclosed embodiments are not limited to particular types of primary and secondary functions or devices and the concepts disclosed may be usefully applied to other configurations and implements.

In accordance with disclosed embodiments, implement 20 also includes a hydraulic flow control circuit 135 that controls the flow of hydraulic fluid within implement 20 to power the primary function actuator 125 and the secondary actuators 130 in response to the signals provided by the operator inputs 110. More particularly, the hydraulic flow control circuit 135 controls the flow of hydraulic fluid to the secondary function actuators 130 to accommodate situations where the primary function actuator 125 is either being actuated or not actuated.

Figure 2:
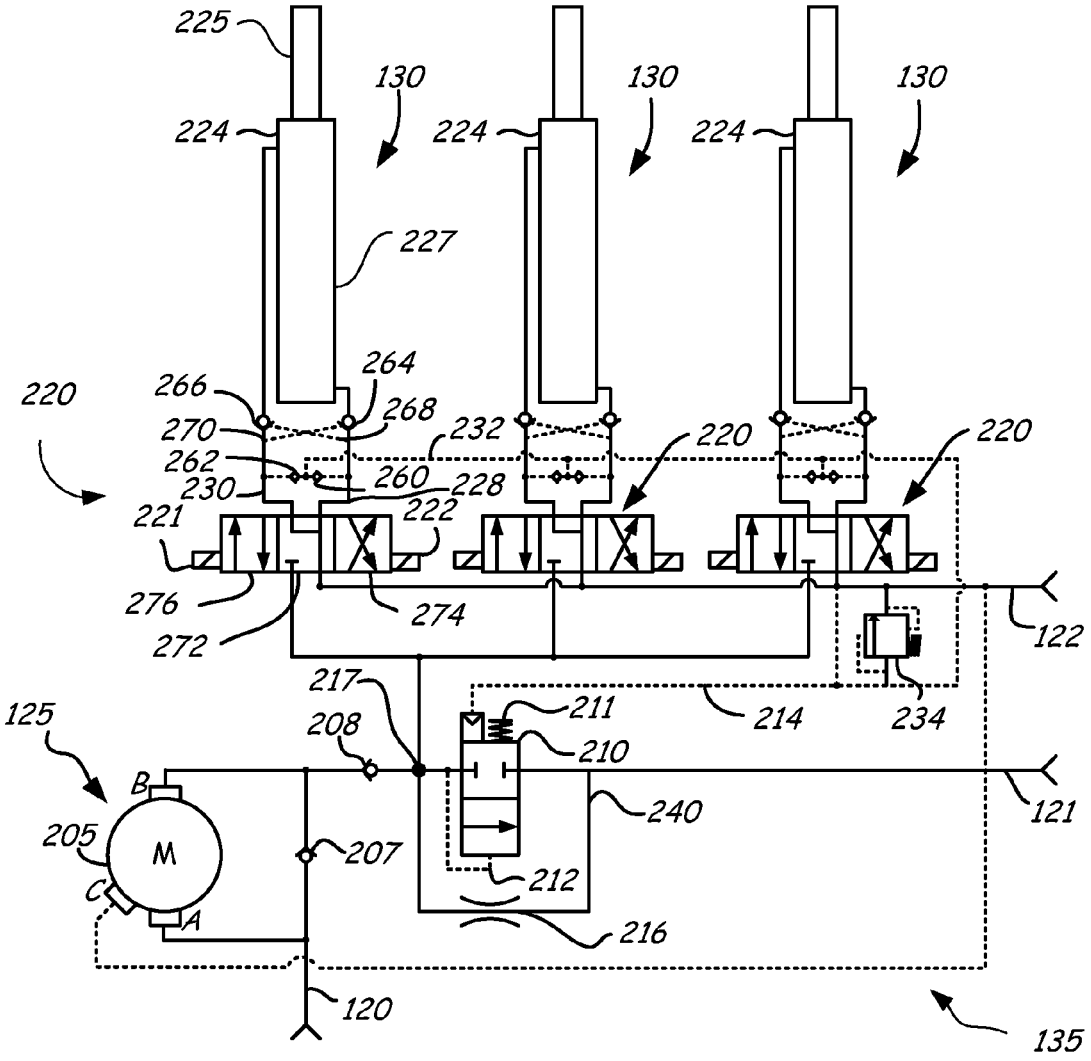
FIG. 2 is a hydraulic schematic diagram illustrating hydraulic components on the implement, shown in FIG. 1, including components of the selectable hydraulic flow control circuit.

Referring now to FIG. 2, shown is a hydraulic schematic diagram illustrating hydraulic components on implement 20, shown in FIG. 1, including components of the hydraulic flow control circuit 135. As shown, in this example embodiment, primary function actuator 125 is a hydraulically driven motor 205. Motor 205 can be a motor for rotating a cutting tool, for example. Motor 205 has an inlet port A, and outlet port B, and a case drain port C. The inlet port A is in communication with first conduit 120 such that it receives hydraulic fluid under pressure when controller 105 causes hydraulic power source 115 to provide hydraulic fluid via conduit 116. Outlet port B is in communication with the hydraulic flow control circuit 135 at node 217 such that fluid that passes through the motor 205 is selectably returned via either the second coupler 121 and to conduit 117 as shown in FIG. 1 or via the third conduit 122 and conduit 118 as is shown in FIG. 1. Case drain port C is in communication with the third conduit 122 and conduit 118 to provide a return to tank from any leakage in the case of motor 205. In the illustrated embodiment, a pair of check valves 207 and 208 prevent hydraulic fluid under pressure from traveling through the motor in the reverse direction.

FIG. 2 illustrates three secondary function actuators 130. The secondary function actuators 130 are shown as being substantially similar in arrangement and they will be discussed for the purposes herein as if they are substantially similar, although it is to be understood that each secondary function actuator 130 is independent of any other secondary function actuators 130, controls different functions on the implement, and may have a substantially different configuration that is depicted in the embodiments discussed herein.

Hydraulic flow control circuit 135 illustratively includes a pilot-operated two-position valve 210 that is in communication with node 217 on a first side of the valve 210 and to the second coupler 121 on a second side of the valve 210. Two-position valve 210 is biased via spring 211 into a first position, shown in FIG. 2 such that it blocks hydraulic fluid from the first side to the second side. A pilot line 212 is in communication with node 217 to provide hydraulic pressure to overcome the bias force of spring 211. When the bias force of spring 211 is overcome, the valve is shifted to a second position, shown in FIG. 3, such that hydraulic fluid from the first side of the valve (i.e. node 217) is provided to the second conduit 121 and back to the power machine 10. A pilot line 214 is in communication an opposing side of the valve 210 and on the same side of spring 211. Pilot line 214 and spring 211 in combination can thus overcome hydraulic forces supplied by pilot line 212 to urge the valve into a blocking position as shown in FIG. 2. A relief valve 234 provides a pressure relief from pilot line 214 to the third conduit 122. Operational conditions will be discussed in more detail below.

A bypass conduit 240 allows hydraulic fluid to flow from the second conduit 121 around the valve 210 to node 217 in situations where it is advantageous to provide hydraulic flow to the secondary function devices 130 via the second coupler as is described in more detail below. A restrictor 216 works to limit flow to node 217.

The secondary function devices 130 as shown in FIG. 2 each includes a hydraulic cylinder 224 and a control valve 220, which controls the flow of hydraulic fluid from node 217 to the hydraulic cylinder 224. Control valve 220 is illustratively a three position, four-way spool valve. A base end conduit 228 is provided from the control valve 220 to the base end side of a piston (not shown) within cylinder 224. A rod end conduit 230 is provided from the control valve 220 to the rod end side of the piston within cylinder 224. Each of the base end conduit 228 and the rod end conduit 230 is in communication with pilot line 214 through check valves 260 and 262 respectively to urge valve 210 into a blocked, first position when pressurized fluid is available at either of the base end conduit 228 or the rod end conduit 230. Check valves 264 and 266 inhibit the passage of hydraulic fluid from the cylinder 224 to the conduits 228 and 230. A cross port 268 from conduit 228 to check valve 266 and a cross port 270 from conduit 230 to check valve 264 allows each of the check valves to be opened and hydraulic fluid to flow in and out of the cylinder 224 when pressurized hydraulic fluid pressure is present from the control valve 220 to either of base end conduit 228 or rod end conduit 230. Hydraulic fluid is evacuated from the secondary function devices 130 via third conduit 122.

In the embodiment shown in FIG. 2, actuators 221 and 222 are provided to shift the valve 220. Actuators 221 and 222 are illustratively electrically actuated solenoid valves that are capable of engaging valve 220 to cause the valve to shift as desired. Although not shown in FIG. 2, actuators 221 and 222 are in electrical communication with implement controller 128 to receive actuation signals. In one embodiment, the valve 220 is biased to a first position 272, shown as the center position in FIG. 2. When valve 220 is in the first position, hydraulic fluid is evacuated from both base end conduit 228 and rod end conduit 230, thereby causing check valves 260, 262, 264, and 266 to close. Actuation of actuator 222 illustratively causes the valve 220 to shift to a second position 274, which allows hydraulic fluid to be provided to the base end conduit 228 and evacuated from the rod end conduit 230, thereby causing rod 225 to extend from the cylinder body 227. Complementarily, actuation of the actuator 221 causes the valve 220 to shift to a third position 276, which allows hydraulic fluid to be provided to the rod end conduit 230 and evacuated from the base end conduit 228, thereby causing rod 225 to retract into the cylinder body 227.

Figure 3:
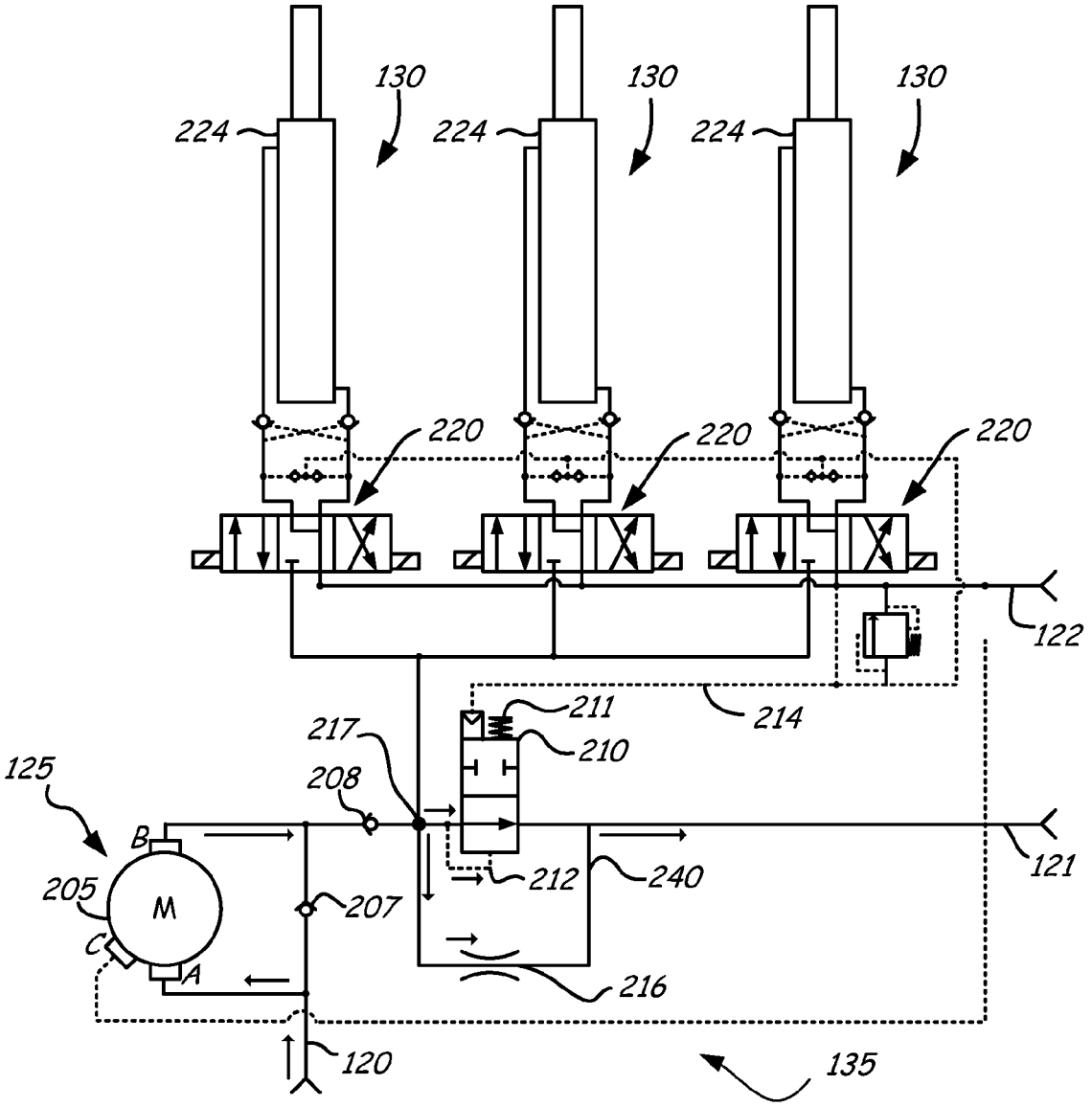
FIG. 3 is an illustration of the hydraulic schematic diagram showing flow of hydraulic fluid through the hydraulic components when the primary function device is activated and the secondary function devices are inactive.

Referring now to FIG. 3, shown is the hydraulic schematic diagram illustrating the above-described components when controlled such that the primary function device is activated and the secondary function devices are inactive. As shown by arrows, to actuate the motor 205, hydraulic fluid flow is provided by the hydraulic power source 115 on power machine 10 to the first conduit 116 to the first conduit 120 on implement 20. Hydraulic power source 115 provides hydraulic fluid in response to actuation signals from controller 105. Controller 105 provides actuation signals in response to signals received from operator inputs 110 and, in one embodiment, from communications from implement controller 128. Hydraulic fluid flows from the first conduit 120, through the motor 205, through check valve 208 and to the pilot line 212, which opens the two-position valve 210, and allows fluid to flow to the power machine 10 through the second conduit 121. Hydraulic fluid is prevented from flowing to the secondary function actuators 224 by control valves 220, which are centered in response to signals or lack of signals from implement controller 128. In this mode of operation, the hydraulic pressure at the input of valve 210 and pilot input 212 maintains the valve in the open position as long as the flow of hydraulic fluid through the motor 205 is maintained. Some return flow may return to conduit 121 via bypass conduit 240 and through flow restrictor 216, although it should be appreciated that most of the return flow passes through the valve 210.

Figure 4:
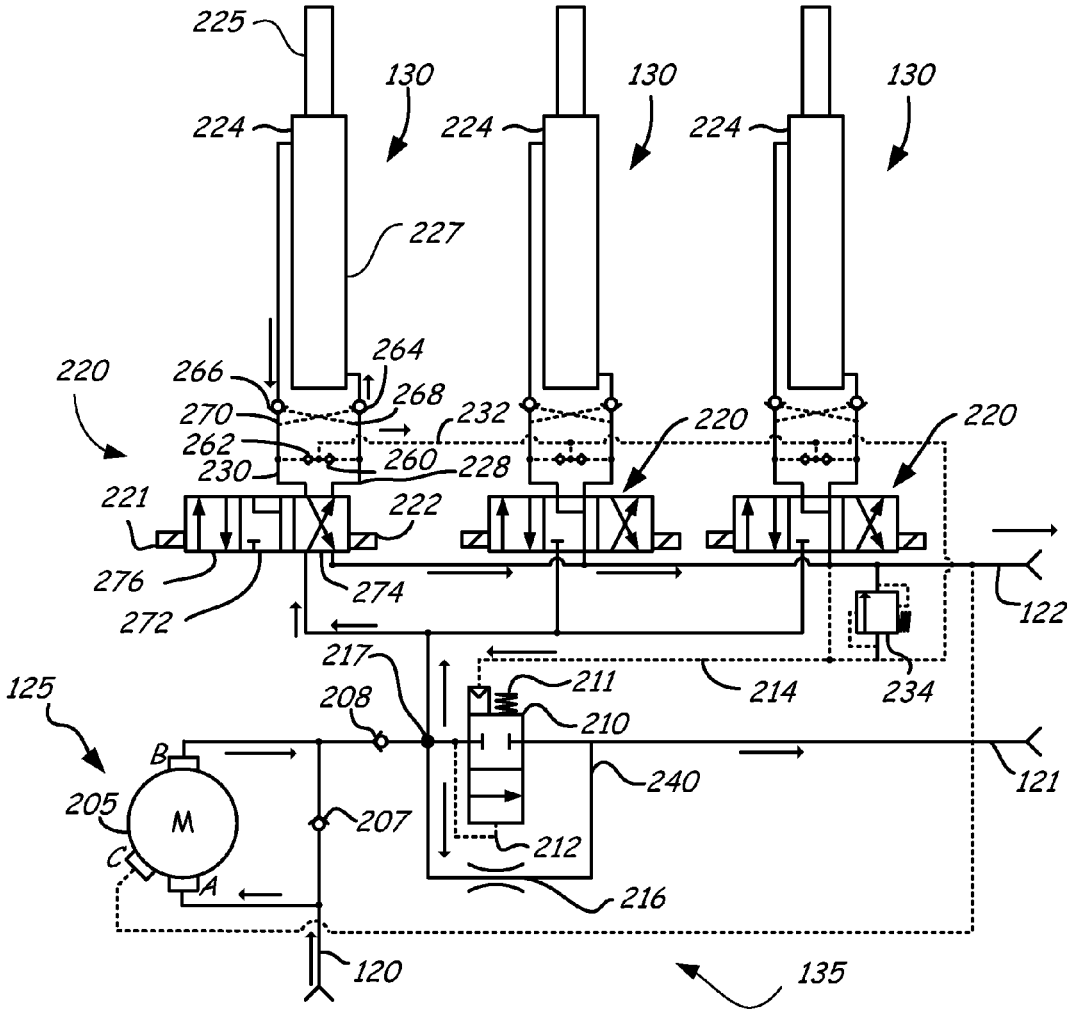
FIG. 4 is an illustration of the hydraulic schematic diagram showing flow of hydraulic fluid through the hydraulic components when both the primary function device and at least one of the secondary function devices are activated.

Referring now to FIG. 4, shown is a hydraulic schematic diagram of implement 20 illustrating the above-described components when controlled such that both the primary function device 125 at least one secondary function device 130 are activated. As shown by arrows, in this mode, hydraulic fluid flow is again provided to the implement 20 through the first conduit 120. In addition, one of the control valves 220 is shown as being shifted to a second position 274, illustratively accomplished by implement controller 128 providing an actuation signal to the solenoid 222. Hydraulic fluid flows through motor 205 and then to node 217. Since spool 220 is no longer blocked, hydraulic fluid flows into the base end conduit 228, through check valve 260 to pilot line 214, keeping valve 210 in a blocked position. At that point, substantially all of the hydraulic fluid that traveled through motor 205 is provided to the secondary circuits and either forced into the cylinder or evacuated through the third conduit 122 or through flow restrictor or orifice 216 and out through second conduit 121. It should be appreciated, as mentioned above, that in some embodiments, actuation devices other than hydraulic cylinders may be employed, meaning that other paths from node 217 to third conduit 122 may be employed.

Using the disclosed hydraulic circuits and modes of operation, when an operator is getting setup to start a cut or other primary function task, he or she can move the primary function tool much faster with the higher flow which can be provided to the auxiliary cylinders. In conventional hydraulic circuits for such power machines and implements, the actuators for the auxiliary features were hydraulically configured to drain to the second conduit 121. Hydraulic fluid would enter in the first conduit 120, be ported under a control method to the secondary function devices 130, and return on the second conduit 121. This type of configuration frequently provided insufficient flow of hydraulic fluid to perform the secondary functions as quickly as desired. Further, with some of the flow diverted from the front side of the primary function circuit in certain designs, the primary function motor would also sometimes be underpowered and slowed. In disclosed embodiments, the secondary function devices 130 drain on the third conduit 122, which provides significant advantages such as are discussed below. With virtually all or most of the hydraulic fluid flowing through the primary function device 125 now being made available at the return side of the motor to the secondary function devices 130, both of the primary and secondary functions can be optimally powered.

Figure 5:
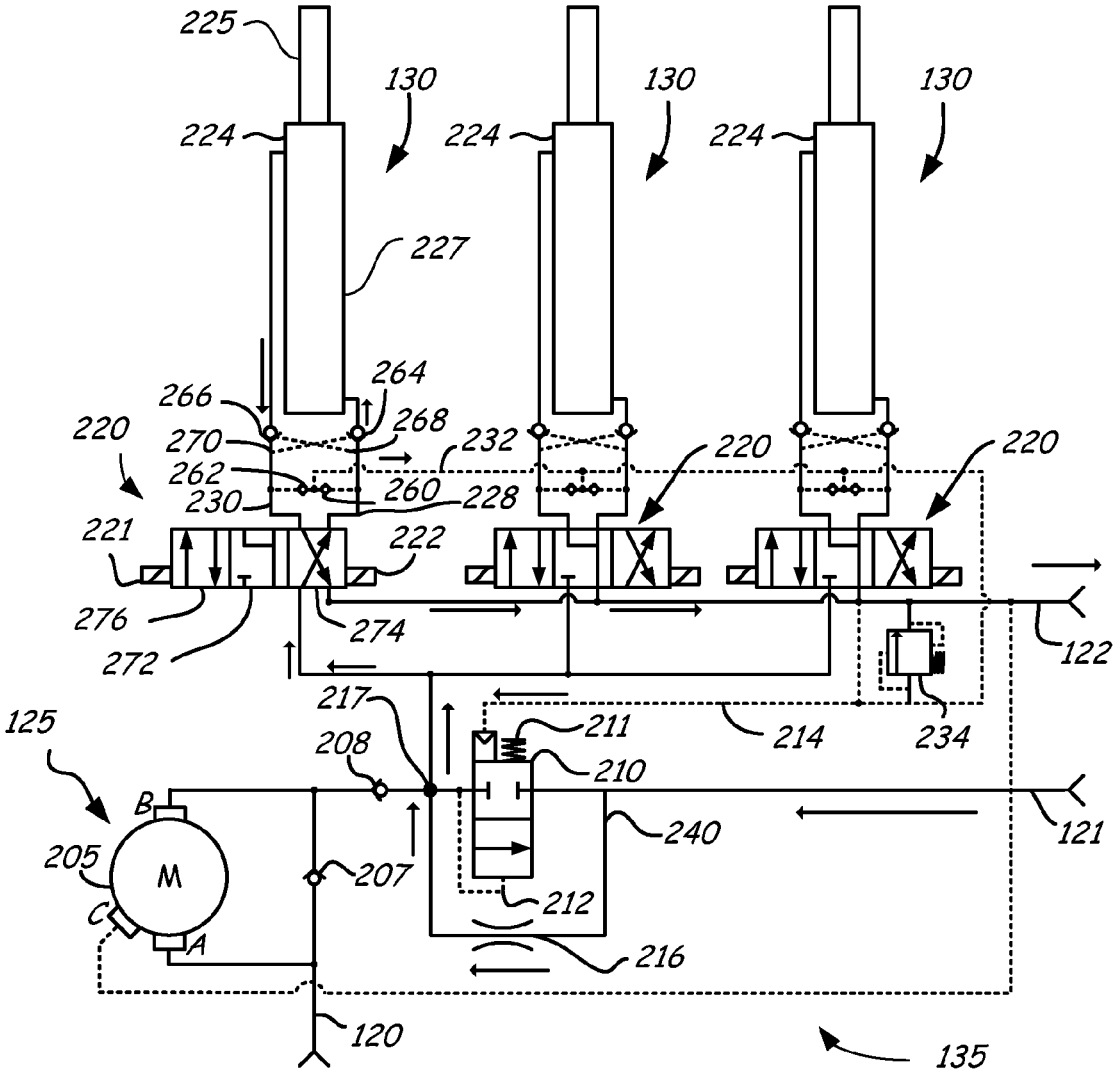
FIG. 5 is an illustration of the hydraulic schematic diagram showing flow of hydraulic fluid through the hydraulic components when the primary function device is inactive and at least one of the secondary function devices is activated.

Referring now to FIG. 5, shown is the hydraulic schematic diagram illustrating the above-described components when controlled such that the primary function device 125 is not powered, but one or more of secondary function devices 130 are activated. In this mode of operation, controller 105 signals, in some embodiments, in response to communication from implement controller 128, hydraulic power source 115 to provide hydraulic fluid to the implement 20 through the second conduit 121 instead of through first conduit 120. As shown by arrows in FIG. 5, in this mode, hydraulic fluid entering second conduit 121 travels through bypass 240, the valve 210 being in a blocked configuration, including through flow restrictor or orifice 216 to node 217. Check valve 208 prevents flow of the hydraulic fluid back through motor 205, so substantially all of the hydraulic fluid travels to the control valves 220. With one or more of the control valves 220 moved by controller 105 to either the first or second position (one of the control valves in FIG. 5 is illustratively shown in the second position 274), to allow flow to the corresponding hydraulic actuators 224 to perform secondary functions. Hydraulic fluid again returns to power machine 10 through the third conduit 122 instead of through the second conduit 121 (or first conduit 120). Thus, secondary functions can be performed in this mode of operation without also powering the primary function circuit. Doing so, less hydraulic fluid flow may be necessary than would have conventionally been the case when only a portion of the hydraulic fluid was diverted from flow through the primary function circuit. In conventional systems, to prevent the primary function device 125 from being actuated when only the secondary functions are intended to be active, it was necessary to include a dump valve that would dump the oil and bypass the motor. Thus, conventional configurations required high flow to the implement even when only the secondary functions were active, but because of the flow divider arrangement, still relatively low flow could be provided to the secondary function circuits, resulting in inefficient use of hydraulic power, leading to an increase in heat in the hydraulic system as well as wasted horsepower.

In summary, the disclosed hydraulic systems and methods provide multiple modes of operation. In primary modes of operation, i.e., when the primary function device is being actuated, hydraulic fluid is provided to the implement through a first conduit and exits through the second conduit 121 and/or the third conduit 122, depending on whether any of the secondary function devices 130 are also being actuated. In secondary modes of operation, i.e., when only secondary function devices 130 are being actuated, hydraulic fluid is provided to the implement through a different conduit (i.e., the second conduit 121).

In a first of the primary modes of operation in which hydraulic fluid enters through the first conduit, the secondary functions are not active and hydraulic fluid can be returned to the power machine through the second conduit without passing through the secondary function circuits. In a second of the primary modes of operation, in addition to the primary function device being active, one or more secondary functions are active. In this instance, the hydraulic fluid entering through the first conduit is also routed through the secondary function devices and can be returned to the power machine through the second and the third conduits.

In a secondary mode of operation in which the primary function is inactive but one or more secondary functions are active, the direction of flow of hydraulic fluid can be altered such that the fluid is ported in the opposite direction by entering the second (e.g., female) coupler and exiting the third coupler (e.g., the case drain coupler). Employing both the first and second conduits as sources of hydraulic fluids and the second and third conduits and return paths of hydraulic fluids provides an opportunity to create flow control circuitry that advantageously allows an implement of the type described in this discussion to more efficiently and effectively manage control of multiple hydraulically controlled devices to achieved improved responsiveness, efficiency and performance in the implement.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. For example, in various embodiments, different types of power machines can include hydraulic systems having one or more of the disclosed concepts. Other examples of modifications of the disclosed concepts are also possible, without departing from the scope of the disclosed concepts.

What is claimed is:

1. A hydraulic system for selectively providing pressurized hydraulic fluid flow to actuators on an implement configured to be hydraulically coupled to a power machine, the implement having a primary function actuator and at least one secondary function actuator, wherein the hydraulic system comprises:

a hydraulic interface including first, second and third conduits to couple to the power machine, wherein each of the first and second conduits are configured to selectively receive pressurized hydraulic fluid from the power machine;

a hydraulic flow control device positioned to selectively control pressurized hydraulic fluid flow from the primary function actuator and to at least one secondary function actuator;

wherein in a first mode of operation the hydraulic flow control device is positioned to direct pressurized hydraulic fluid flow returned from the primary function actuator out of the implement through the second conduit; and wherein in a second mode of operation, the hydraulic flow control device is positioned to prevent pressurized hydraulic fluid flow returned from the primary function actuator out of the implement through the second conduit via the hydraulic flow control device.

2. The hydraulic system of claim 1, wherein in a third mode of operation the hydraulic flow control device is positioned to provide pressurized hydraulic fluid received from the power machine through the second conduit to at least one secondary function actuator.

3. The hydraulic system of claim 2 and further comprising a blocking element configured to prevent pressurized hydraulic fluid from being provided to the primary function actuator in the third mode of operation.

4. The hydraulic system of claim 2, wherein the implement is configured to receive pressurized hydraulic fluid flow from only one of the first and second conduits at a time.

5. The hydraulic system of claim 1, wherein in the first and second modes of operation, the hydraulic system is configured to receive pressurized hydraulic fluid from the power machine via the first conduit.

6. The hydraulic system of claim 1, wherein in the second mode of operation, pressurized hydraulic fluid returned from the primary function actuator is directed toward the secondary function actuator.

7. The hydraulic system of claim 6, wherein in the second mode of operation, pressurized hydraulic fluid flow returned from the secondary function actuator is directed out the third conduit.

8. The hydraulic system of claim 1, wherein the primary function actuator is a hydraulic motor and wherein the primary function actuator is in communication with the third conduit to allow hydraulic fluid leaked in the motor to exit the motor.

9. The hydraulic system of claim 1, wherein at least one secondary function actuator is an actuator capable of positioning the primary function actuator.

10. The hydraulic system of claim 1 and further comprising a first check valve connected in parallel with the primary function actuator such that all hydraulic fluid provided to the implement through the first conduit must be provided to the primary function actuator.

11. The hydraulic system of claim 10, and further comprising a second check valve connected in series with the primary function actuator and first check valve to prevent pressurized hydraulic fluid from being directed out of the first conduit in the third mode of operation.

12. The hydraulic system of claim 1 and further comprising a bypass conduit in parallel with the hydraulic flow control device.

13. An implement configured to be attached to a power machine and hydraulically coupled to a hydraulic source on the power machine, the implement comprising:

a hydraulically powered primary function device;

at least one secondary function device;

a hydraulic interface including first, second, and third conduits to hydraulically couple the implement to the hydraulic source; and a hydraulic flow control circuit coupled to the first, second, and third conduits, wherein the hydraulic flow control circuit is configured to control hydraulic fluid flow to the primary function device and to at least one secondary function device, in first, second and third modes of operation selected based upon which of the primary function device and at least one secondary function device is active, wherein in the first mode of operation hydraulic fluid is provided to the implement through the first conduit and the hydraulic flow control circuit is configured such that the hydraulic fluid exits from the implement at least partially through the second conduit, wherein in the second mode of operation hydraulic fluid is provided to the implement through the first conduit and the hydraulic flow control circuit is configured such that the hydraulic fluid exits from the implement at least partially through the third conduit, and wherein in the third mode of operation hydraulic fluid is provided to the implement through the second conduit and the hydraulic fluid control circuit is configured such that the hydraulic fluid exits from the implement through the third conduit.

14. The implement of claim 13, wherein the hydraulic flow control circuit is configured to control hydraulic fluid flow through the implement such that in the first mode of operation the primary function device is active and no secondary function device is active, such that in the second mode of operation the primary function device and at least one secondary function device are both active, and such that in the third mode of operation the primary function device is not active and at least one secondary function device is active.

15. The implement of claim 13, wherein in the second mode of operation the hydraulic flow control circuit is configured such that after the hydraulic fluid is provided to the primary function device a first portion of the hydraulic fluid exiting the primary function device is provided to the at least one secondary function device before exiting the implement from the third conduit, and a second portion of the hydraulic fluid exiting the primary function device exits the implement from the second conduit.

16. The implement of claim 13, wherein the primary function device is connected to the first conduit such that all hydraulic fluid provided to the implement through the first conduit must be provided to the primary function device, and further comprising a valve arrangement coupled to the first conduit and configured such that hydraulic fluid cannot exit the implement through the first conduit.

17. The implement of claim 13, wherein the hydraulic flow control circuit further comprises a pilot-operated valve coupled in fluid communication at a first side with the primary function device and at a second side with the second conduit, and a bypass conduit in parallel with the pilot-operated valve between the first and second sides, wherein in the first mode of operation the pilot-operated valve is in an open position which ports hydraulic fluid from the primary function device to the second conduit, wherein in the second mode of operation the pilot-operated valve is in a closed position which forces at least some of the hydraulic fluid from the primary function device to be provided to at least one secondary function device, and wherein in the third mode of operation the pilot-operated valve is in the closed position and hydraulic fluid provided to the implement through the second conduit flows through the bypass conduit to bypass the pilot-operated valve and is provided to the at least one secondary function device.

18. The implement of claim 17, wherein the hydraulic flow control circuit further comprises at least one control valve hydraulically coupled between the first side of the pilot-operated valve and at least one secondary function device to selectively port hydraulic fluid from the first side of the pilot-operated valve to the at least one secondary function device and to port oil from the at least one secondary function device to the third conduit.

19. A method of controlling hydraulic fluid flow received from a power machine on an implement having a primary function device and a secondary function device, the method comprising:

receiving hydraulic flow from the power machine via one of first and second conduits;

controlling a hydraulic flow control valve on the implement to control hydraulic fluid flow to the secondary function device;

wherein in a first mode, hydraulic fluid is provided via the first conduit to the primary function device and the hydraulic flow control valve is configured to direct hydraulic fluid returned from the primary function device to exit from the implement through the second conduit via the hydraulic flow control valve;

wherein in a second mode, hydraulic fluid is provided via the first conduit to the primary function device and the hydraulic flow control valve is configured to block hydraulic fluid returned from the primary function device from exiting the implement through the second conduit via the hydraulic flow control valve and to direct a portion of the hydraulic fluid returned from the primary function device toward the secondary function device and out of the implement through a third conduit; and wherein in a third mode, hydraulic fluid is received through the second conduit, and the hydraulic fluid control valve is configured such that the hydraulic fluid is provided to the secondary function device and exits from the implement through the third conduit.

20. The method of claim 19 and further comprising blocking hydraulic fluid from the primary function device in the third mode.

* * * * *